US005335823A

United States Patent [19]

Fuchs et al.

[11] Patent Number: 5,335,823

[45] Date of Patent: Aug. 9, 1994

[54] DISPENSER FOR MEDIA

[75] Inventors: Karl-Heinz Fuchs, Radolfzell; Lothar Graf, Rielasingen-Worblingen, both of Fed. Rep. of Germany

[73] Assignee: Ing. Erich Pfeiffer GmbH & Co. KG, Fed. Rep. of Germany

[21] Appl. No.: 59,513

[22] Filed: May 7, 1993

Related U.S. Application Data

[63] Continuation of Ser. No. 751,159, Aug. 28, 1991, abandoned.

[30] Foreign Application Priority Data

Aug. 31, 1990 [DE] Fed. Rep. of Germany ..... 4027672

[51] Int. Cl.[5] ..... B67D 5/26

[52] U.S. Cl. ..... 222/36; 222/153; 222/321

[58] Field of Search ..... 222/36, 153, 321; 239/333

[56] References Cited

U.S. PATENT DOCUMENTS

| | | | |
|---|---|---|---|
| 4,368,830 | 1/1983 | Soughers . | |
| 4,565,302 | 1/1986 | Pfeiffer et al. | 222/38 |
| 4,848,595 | 7/1989 | Foster et al. . | |
| 4,871,092 | 10/1989 | Maeyte | 222/321 X |
| 4,934,568 | 6/1990 | Fuchs | 222/321 X |
| 4,946,069 | 8/1990 | Fuchs | 222/321 X |

*Primary Examiner*—Michael S. Huppert
*Assistant Examiner*—Kenneth Bomberg
*Attorney, Agent, or Firm*—Quarles & Brady

[57] ABSTRACT

A discharge apparatus (1) has for the discharge actuating device (5) a self-engaging catch system (29) against further actuation at the end of each actuating cycle. For unlocking purposes an actuator (11, 23) must be manually rotated and simultaneously adjusting cams (33) of a discharge counter (20) are so transferred into an operating position, that they perform an indexing step during the next stroke.

17 Claims, 1 Drawing Sheet

FIG. 1
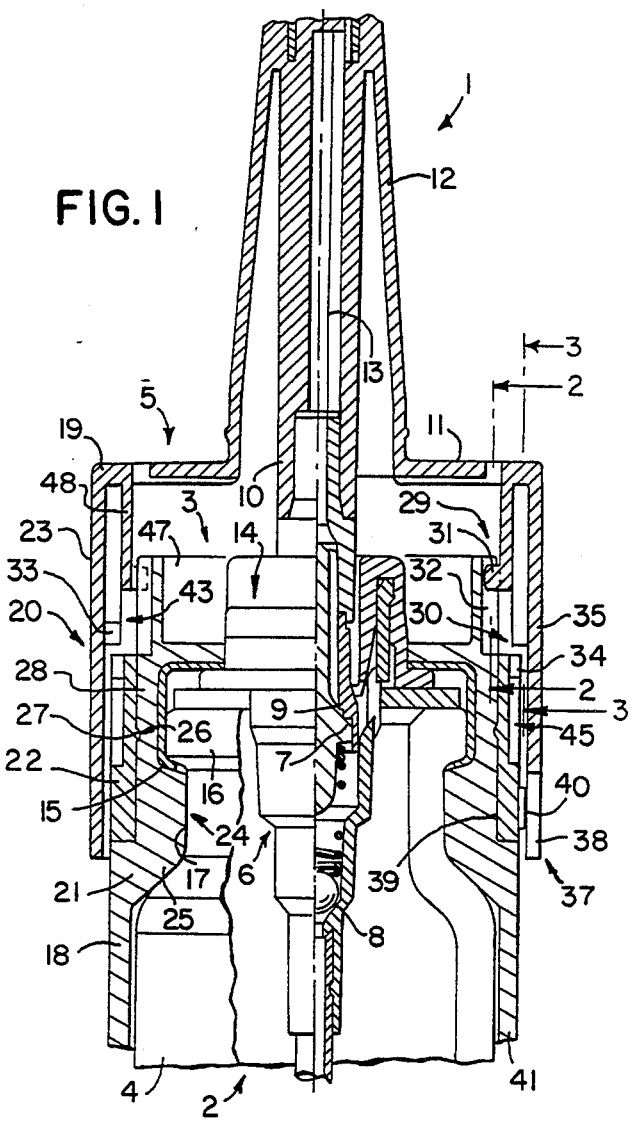
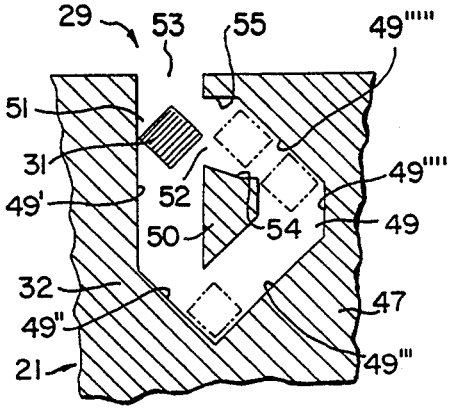
FIG. 2
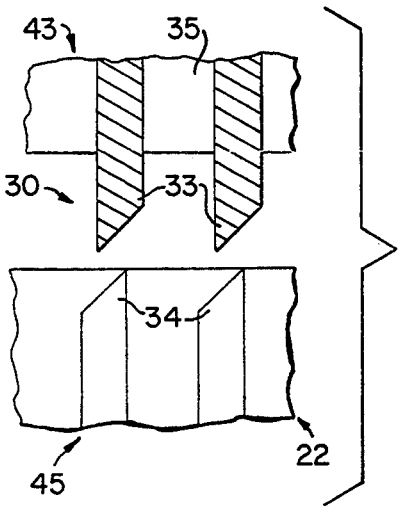
FIG. 3

DISPENSER FOR MEDIA

This is a continuation of application Ser. No. 07/751,159, filed Aug. 28, 1991, (now abandoned).

BACKGROUND OF THE INVENTION

The invention relates to a discharge apparatus for media of a random type, which is provided for performing a discharge process with one or more discharge actuating means. The dispenser is advantageously constructed in such a way that it can be moved backwards and forwards in one or more motion cycles in manual manner between one or more starting positions and one or more end positions. In one or more of these positions, the discharge actuating means can be fixed by one or more catch systems at least within certain movement limits against movements in the actuating direction, and/or return direction and the catch system can be released again by one or more manual actuations. Such catch systems can be provided as originality protection means or to prevent unauthorized or accidental use by children and are therefore particularly appropriate if pharmaceutical, cosmetic or other flowable media are to be discharged.

SUMMARY OF THE INVENTION

An object of the invention is to provide a discharge apparatus for media, which avoids the disadvantages of known constructions and offers high reliability by engaging the catch system.

This object is achieved in that the catch system is constructed in self-engaging manner as a function of at least one actuating movement. Thus, after one or more actuating cycles it can be automatically transferred into the locking position, so that for performing a following actuating cycle randomly or deliberately a release must take place. Locking can take place in the starting position, actuating position and/or an intermediate position and can act both against actuation and against return or against one of these movements only and several locking positions with the same or different locking action are possible.

Unlike in the case of a force-dependently overcomeable locking effect e.g. for successive partial strokes of an overall stroke of the discharge actuating means, the catch system appropriately operates positively with respect to the associated actuating direction of the discharge actuating means, so that the locking effect is only to be removed by a movement differing from the actuating movement for the discharge. In the case of the unidirectional release movement, it would be necessary to have at least one actuating movement for release only and then a second actuation for performing the discharge.

In any event, it is advantageous if there are not separate handles for performing the separate functions of discharging and unlocking the catch, but only one handle for both actuating the discharge by opening a valve, opening a pipette, a pump, etc. and for unlocking the catch. The handle can form separate actuators on its circumference and its end face for the discharge and the unlocking and can be movable both in approximately linear axial manner and also rotatably.

The invention also provides a releasable, removable prevention means for a discharge and actuating head of the discharge apparatus, so that although the latter is removable, it is positively secured against accidental removal when the discharge apparatus is stored. This removal preventing means is preferably formed by one of the aforementioned catch systems, which has the aforementioned features.

In order to determine, store and indicate data relevant for the use of the discharge apparatus, it is appropriate to provide a determining device, which is advantageously located directly on the discharge apparatus and is not formed by a spatially separate device. Such data can consist of the number of uses which have taken place, the next-following use time or other data, which can be rendered visible by means of one or more synchronously or separately operated displays.

Appropriately, the movements of the determining device are synchronized with state changes of the catch system, and a rotary position change of the display with or without a change of the display symbol or a transfer of the determining device into a readiness position can be provided in such a way that the determining device is indexed during the following discharge process. Thus, a servodrive for actuating the determining device can be given a very simple construction and merely has sloping cam faces, which convert a lift movement into a rotary movement.

A body, which receives the associated locking members of the catch system and at least one determining member of the determining device can be formed by one component, which is fixed separately from the body of the discharging means, e.g. on a medium storage vessel. Thus, the same, preassembled discharge unit can subsequently be provided with any one of the said constructions or said device can be replaced by another one. As a function of the particular use different scales, different servodrives, etc. can be provided. In a very simple embodiment the cams of the catch system and/or the determining device or an indicator, such as an indicating window are located on the discharge head an constructed in one piece therewith.

The catch system can simultaneously form a rotation prevention means against the forces occurring during the indexing of the determining device.

These and further features can be gathered from the claims, description and drawings, either singly or in the form of subcombinations, can be realized in an embodiment of the invention and in other fields and can represent advantageous, independently protectable constructions for which protection is hereby claimed. An embodiment of the invention is described hereinafter relative to the drawings, wherein show:

BRIEF DESCRIPTION OF THE DRAWINGS

FIG. 1 an invention discharge apparatus in axial section.

FIG. 2 a detail from FIG. 1 of a locking link at the beginning of a stroke cycle.

FIG. 3 a detail from FIG. 1 of the cam face interaction at the beginning of a stroke cycle.

DETAILED DESCRIPTION OF THE PREFERRED EMBODIMENTS

A discharge apparatus 1 has as a closed assembly a discharge unit 2 with a discharging means 3 and a storage vessel 4, which are manually operable by a discharge actuating means 5. The piston unit 7 of a pump 6 largely engaging in the storage vessel 4 is operated and its pump chamber has a valve-controlled inlet 8 and a valve-controlled outlet 9. For operating purposes is provided a piston or operating rod 10, which is connected to a delivery handle in the form of an actuator 11 as a pressure surface surrounding it and is located by means of a plug connection on the piston rod of the piston unit 7. The actuating rod 10 is traversed by an outlet channel 13 connected to the outlet 9, is surrounded by a discharge connecting piece 12 constructed in one piece therewith and located roughly in the pump axis and has in the vicinity of its end face the outlet of the discharge unit 2 leading into the open. The cylinder casing forms with a cylinder cover a body 14 with which the discharging means 3 is fixed by a fastening member 15, e.g. a crimp ring engaging round a cap-like vessel flange 16 to a vessel neck 17. Between said vessel flange 16 and the vessel bulge 18 the vessel neck 17 forms on the outer circumference a circular groove, which on one side can be bounded by the fastening member 15. The part of the body and the fastening member 15 projecting from the storage vessel 4 are engaged over by a cap 19, whose end face forms the delivery handle 11.

For the automatic determination of each actuating stroke, a determining device 20 is provided, whereof a sleeve-like body 21 is engaged on the discharge unit 2 and which carries on the outer circumference a rotatable, but axially secured sleeve-like determining member 22. The determining member 22 is rotatable by the actuator formed by the handle 11 about the central axis of the discharge apparatus in identical angular steps. The body 21 is axially mounted from the front end on the discharge unit 2 and is prevented from rotating by a stop member or snap connection 24 in such a way that it can only be rotated with respect to the discharge unit 2 by a relatively high force. On the inner circumference of the body 21 the snap connection has a torus 25, which can be subdivided into individual snap cams, which engage in substantially clearance-free manner in a circular groove formed by the vessel neck 17 between the vessel flange 16 and the vessel bulge 18.

The determining member 22 is rotatably mounted and axially secured by a snap connection 26 on an external diameter-reduced portion of the body 21. The connection 26 has a torus 27 engaging in a circular groove, so that the determining member 22 can be replaced. The determining member 22 surrounding the fastening 15 forms a substantially continuous, uninterrupted extension of the outer circumference of the body 21. As a result of its substantially whole-area engagement on the outer circumference of the associated portion of the jacket 28 of the body 21, the determining member 22 is mounted by means of a friction connection 39. Immediately upstream of the front face of the determining member 22, the delivery handle 11 and the actuator 23 of the cap 19 and the body 21 engage in one another by means of a catch system 29, which after performing a complete pump stroke is so automatically engaged at the end of the return stroke that the next pump stroke can only be performed if the cap 19 is actuated in a manner differing from the pump stroke movement by rotating the delivery handle 11 and/or the actuator 23.

Axially behind the catch system the delivery handle 11 engages by means of a servodrive 30 in the determining member 22 in such a way that it is indexed by one step at the start of each delivery stroke. The catch system 29 has two or more uniformly distributed locking cams 31 provided in one piece on the cap 19 and projecting radially inwards from a bush 48 and which in each case engage in a slotted link 32 on the outer circumference of a freely projecting bush 47 at the front end of the body 21. On the inner circumference of the jacket 35 of the cap 19, the servodrive 30 has circumferentially uniformly distributed, axial web-like adjusting cams 33 with sloping end faces, with which are associated countercams on the outer circumference of the front end of the determining member 22. In rib-like manner the adjusting cams 33 connect the jacket 35 and the bush 48 emanating from the end wall of the cap 19, so that very high stability is ensured even in the case of the thin-walled construction.

In the starting position the adjusting cams 33 are located completely outside the grooves between the countercams 34. The sloping faces of the cams run onto one another pairwise, so that the determining member 22 is rotated, whilst the cap 19, although performing a reciprocating rotary movement with respect to the body 21 during the pump stroke and return stroke as a result of the interengaging members of the catch system 29, at the end of the return stroke it assumes virtually the same rotary position with respect to the body 21 as at the start of the pump stroke. The adjusting cams 33 form a one-piece adjusting member 43 with the handles and the countercams 34 a one-piece adjusting member 45 with the determining member 22.

The jacket 35 can be displaceably and rotatably mounted relatively closely adapted to the outer circumference of the determining member 22 and the body 21, so that only limited bearing forces have to be transferred to the bearing formed by the displaceable piston unit 7 and which also carries the cap 19. After removing the cap 19 connected by means of a plug connection to the piston unit 7, the determining member 22 or with it the body 21 can be removed as a subassembly and replaced. The return of the catch system 29 and the servodrive 30 to the starting position takes place through a return spring of the pump 6 provided in the discharging means 3, so that no separate spring is required.

To show the operating state of the determining device 20 from the outside an indicating device 37 is provided, having in the rear end of the jacket 35 an indicating window 38 and in the starting position in said area and on the outer circumference of the determining member 23 a scale 40 with symbols uniformly distributed over the circumference. The scale 40 is so provided directly behind the adjusting member 45 at the rear end of the determining member 22, that in any operating state a symbol can be seen through the indicating window 38.

The slotted link 32 has on the outer circumference of the bush 47 a slot-like open link guide 49, which is closed approximately circularly about a link core 50 and has polygonally connected guide positions, which are bounded on one side by the link core 50. In the starting position the locking cam 31 is located on the link start 51, to which is connected a roughly axial portion of the link guide 49. The latter forms one of six angularly connected link portions. In the pump stroke end position the locking cam 31 is located in the transition between the second and third link portions, as is shown by the dot-dash positions in FIG. 2.

During the return stroke the locking cam 31 consequently does not return into the axial link portion and is instead laterally deflected by the link core 50. The last link portion issues with a transition at right angles to the axial link portion into the link start 51 and its sides form stop members 54, 55 for the locking cam 31 located at right angles to the lift direction. Thus, at the end of the return stroke the locking cam 31 is located between said stop members 54, 55 immediately laterally adjacent to the link start 51, so that axial movements of the cap 19 are positively blocked in both opposite directions.

Appropriately the cross-sectionally roughly rectangular or square locking cam 31 is so arranged in rhomboid manner, that in the first and fourth link portions 49' and 49'''' and between the lock members (54, 55) it is only guided or supported with the corner edges, whereas in the second, third and fifth link portions 49', 49''' and 49'''' it can be guided substnatially flat on the outer link side. The locking cam 31 can be introduced or removed by means of a link inlet 53 into the annular link and which is appropriately located in the extension of the link start 51 or the first link portion immediately adjacent to the link start.

If the locking cam 31 is located between the stop members 54, 55, a rotary movement of the cap 19 by a few radians is necessary for transferring the locking cam 31 to the link start 51. With the same rotary movement the adjusting cams 33 are so rotated in or opposite to the indexing rotation direction of the determining member 22, that they are no longer aligned with the grooves between the countercams 34 and instead the latter are again located in the running path of the adjusting cams 33. The adjusting cams 33 engage with the countercams 34, whilst the locking cam 31 of the first link portion passes through and then, until shortly before reaching the locking members 54, 55, they are constantly engaged in such a way that there is a rotational connection between the cap 19 and the determining member 22 and are disengaged again before reaching the locked position, so that the determining member 22 is only held by the frictional connection 39. During the automatically controlled passage of the locking cam 31 through the second to fifth link portions, the cap 19 with the determining member 22 consequently performs a reciprocating rotary movement with respect to the body 21.

The body 21 can form a sleeve 41 surrounding the storage vessel 4 over approximately its entire height and which can approximately extend up to or over and beyond the bottom of the storage vessel, so that the appropriately glass vessel 4 is well protected against damage.

we claim:

1. A dispenser for media comprising:

a basic body mountable to a storage vessel for the media;

at least one discharge actuating means for activating a discharge of the media from the vessel, said discharge actuating means being movable in a motion cycle path between an initial position and an actuated position relative to said basic body;

manually releasable catch means, said discharge actuating means being lockable relative to said basic body by said manually releasable catch means against an actuating motion along said motion cycle path, said actuating motion beginning from a starting position on a return path returning back from the actuated position, wherein said catch means repeatedly automatically self-engages only after said discharge actuating means is moved to said actuated position to lock said discharge actuating means relative to said basic body after each movement to said actuated position, said catch means being operationally releasable to an unlocked configuration and remaining unlocked without a discharge actuating operation of the discharge actuating means; and a determining device, wherein a release motion of said catch means substantially simultaneously engages motion of a control device of said determining device to permit functioning of said determining device.

2. The dispenser according to claim 1, wherein said catch means self-engages in said initial position during each travel of said discharge actuating means through said motion cycle path, said initial position being said starting position.

3. The dispenser according to claim 1, wherein said catch means in a locking position forms a positive, non-frictional lock against activating a discharge of the media.

4. The dispenser according to claim 1, wherein said catch means is releasable via a release motion divergently directed with respect to the actuating motion.

5. The dispenser according to claim 1, wherein said actuating means is movable linearly for moving through the motion cycle path and movable in rotary manner for performing a release motion for releasing said catch means.

6. The dispenser according to claim 1, wherein said catch means provides at least one link catch having at least one link guide for a locking cam.

7. A dispenser for media comprising:

a basic body mountable to a storage vessel for the media;

at least one discharge actuating means for activating a discharge of the media from the vessel, movable in a motion cycle path between an initial position and an actuated position relative to said basic body;

manually releasable catch means, said discharge actuating means being lockable relative to said basic body by said manually releasable catch means in repeated manner against an actuating motion beginning from a position in said motion cycle path, wherein said catch means automatically self-engages said discharge actuating means during said motion cycle, wherein said catch means provides at least one link catch having at least one link guide for a locking cam, wherein said link guide emanates from a link start and returns to said link start, said link guide defining a guide center and a guide periphery, at least one of said guide center and said guide periphery providing a stop member for an actuating stop.

8. The dispenser according to claim 7, wherein said link guide is bounded directly adjacent to said guide start by opposite barrier surfaces forming a transition for transferring said actuating stop to said guide start.

9. The dispenser according to claim 1, wherein a locking member of said catch means is provided on said basic body.

10. The dispenser according to claim 9, wherein said basic body is fastened on said storage vessel by one of:

a plug-inserting connection and a snap connection.

11. The dispenser according to claim 1, wherein said catch means is located within a jacket of said actuating means.

12. The dispenser according to claim 1, wherein said actuating means is mounted to said basic body by a snap connection to said catch means, said actuating means having a cam inserted in a link slot of said catch means.

13. The dispenser according to claim 1, wherein a determining device is provided for at least one of operations defined by a counting operation and an indicating operation as a function of discharge operations, said determining device being positively controlled by said discharge actuating means.

14. The dispenser according to claim 1, further comprising a determining device having a counter cam and being activated by engagement of said countercam with a control cam connected to said discharge actuating means.

15. The dispenser according to claim 14, wherein said at least one control cam is transferable into said initial position by a release motion of said catch means, said release motion being oriented transversely to a control motion of said control cam; in said initial position, said at least one countercam being located in a motion path of said at least one control cam with respect to a controlling operating direction.

16. The dispenser according to claim 1, further comprising a determining device and wherein at least one control member of a control drive of said determining device is prevented from rotating in at least one position by said at least one catch means.

17. The dispenser according to claim 16, wherein locking members of said catch means are substantially continuously in mutual guiding engagement at least during releasable operating engagement of control cams of said at least one determining device.

* * * * *